US009228776B2

(12) United States Patent
Burke et al.

(10) Patent No.: US 9,228,776 B2
(45) Date of Patent: Jan. 5, 2016

(54) REFRIGERATOR PANTRY COMPARTMENT

(71) Applicant: Whirlpool Corporation, Benton Harbor, MI (US)

(72) Inventors: Julia B. Burke, St. Joseph, MI (US); Ashish Dongarmal Gogad, Cedar Rapids, IA (US); Anant Ravindra Karanjikar, Pune (IN); Dean A. Martin, Solon, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 14/187,411

(22) Filed: Feb. 24, 2014

(65) Prior Publication Data

US 2015/0241117 A1 Aug. 27, 2015

(51) Int. Cl.
*F25D 23/06* (2006.01)
*F25D 11/02* (2006.01)

(52) U.S. Cl.
CPC ..... *F25D 23/065* (2013.01); *F25D 11/02* (2013.01)

(58) Field of Classification Search
CPC ..... F25D 23/069; F25D 2400/04; F25D 2400/06; F25D 23/065
USPC ..... 312/402, 404, 407, 407.1, 351; 108/25
See application file for complete search history.

(56) References Cited

U.S. PATENT DOCUMENTS

| | | | | |
|---|---|---|---|---|
| 2,898,173 | A * | 8/1959 | Squire | 312/248 |
| 3,815,669 | A | 6/1974 | Lindenschmidt | |
| 4,191,434 | A | 3/1980 | Powell et al. | |
| 4,644,753 | A * | 2/1987 | Burke | 62/3.6 |
| 6,290,314 | B1 * | 9/2001 | Kim | 312/407 |
| 7,228,704 | B2 | 6/2007 | Rand et al. | |
| 7,380,410 | B2 | 6/2008 | Rand | |
| 7,475,562 | B2 * | 1/2009 | Jackovin | 62/344 |
| 2006/0226749 | A1 * | 10/2006 | Kim | 312/404 |
| 2007/0137242 | A1 * | 6/2007 | Marques et al. | 62/407 |
| 2008/0314054 | A1 * | 12/2008 | An et al. | 62/179 |
| 2013/0038193 | A1 | 2/2013 | Dawson et al. | |
| 2013/0043780 | A1 * | 2/2013 | Ootsuka et al. | 312/402 |
| 2013/0127322 | A1 * | 5/2013 | Seo et al. | 312/404 |
| 2013/0257253 | A1 * | 10/2013 | Haltmeyer et al. | 312/404 |
| 2014/0000303 | A1 * | 1/2014 | Jeong et al. | 62/344 |
| 2014/0210331 | A1 * | 7/2014 | Tunzi | 312/404 |
| 2015/0059399 | A1 * | 3/2015 | Hwang et al. | F25D 11/02 62/441 |
| 2015/0115790 | A1 * | 4/2015 | Ogg | F25D 23/069 312/404 |

FOREIGN PATENT DOCUMENTS

| | | | |
|---|---|---|---|
| EP | 2119987 | * | 5/2008 |

* cited by examiner

*Primary Examiner* — Janet M Wilkens

(57) ABSTRACT

A compartment for storing items in a mullion wall separating refrigerated compartments is provided. One exemplary embodiment provides a refrigerator with a first refrigerated compartment selectively coverable by a first door and a second refrigerated compartment selectively coverable by a second door. A mullion separates the first and second refrigerated compartments. A storage compartment is located in the mullion and separable from the first refrigerated compartment by a selectively closeable lid.

20 Claims, 5 Drawing Sheets

REFRIGERATOR PANTRY COMPARTMENT

BACKGROUND

I. Field of the Disclosure

This disclosure relates to a compartment for storing items in a refrigerated compartment. More specifically, but not exclusively, the present disclosure relates to a compartment for storing items in a mullion wall between refrigerated compartments.

II. Description

Continual efforts are made to increase and/or use storage space within a refrigerator. This effort often includes identifying ways to use existing space more efficiently to provide additional storage opportunities.

Therefore, it is an object, feature, or advantage of this disclosure to provide a storage compartment in previously unutilized space within a refrigerated compartment.

The various styles of refrigerators offer different opportunities for using known space within the refrigerator a new way or identifying previously unused space for use in new ways. The space located between two refrigerated compartments, such as in a mullion wall, can be used more efficiently.

Therefore, another object, feature, or advantage of this disclosure is to provide a storage compartment in a space within a mullion wall.

Another object, feature, or advantage of this disclosure to provide a storage compartment that is accessible through a refrigerated compartment.

A still further object, feature, or advantage of this disclosure to provide a storage compartment in a wall separating two refrigerated compartments.

One or more of these and/or other objects, features or advantages of this disclosure will become apparent from the specification and claims that follow.

SUMMARY

This disclosure is directed generally to a storage compartment located in a mullion wall of a refrigerated compartment.

One exemplary embodiment provides a refrigerator with a first compartment selectively coverable by a first door and a second compartment selectively coverable by a second door. A mullion separates the first and second compartment. A storage compartment is located in the mullion and separable from the first compartment by a selectively closeable lid. In a one aspect, the first and second compartments are refrigerated compartments.

Another embodiment provides a refrigerator with two or more adjoining compartments selectively coverable by one or more doors. A mullion wall is located between the two or more compartments. A storage compartment is formed in part by a set of compartment walls circumscribed by an opening within the mullion. A selectively closeable lid is disposed over the opening for separating the storage compartment from one of the two or more compartments. An aspect the embodiment includes the two or more compartments being refrigerated compartments.

Yet another embodiment provides a refrigerator with a fresh food compartment selectively coverable by one or more doors and a fresh food drawer disposed beneath the fresh food compartment. A mullion is disposed between the fresh food compartment and the fresh food drawer. The mullion has a top wall and a food storage compartment is disposed within the mullion. The food storage compartment has an opening disposed in the top wall of the mullion. A cover is selectable between open and closed positions disposed over the opening of the food storage compartment.

BRIEF DESCRIPTION OF THE DRAWINGS

Illustrated embodiments of the present disclosure are described in detail below with reference to the attached drawing figures, which are incorporated by reference herein, and where.

DETAILED DESCRIPTION OF THE PREFERRED EMBODIMENTS

Figure 1:
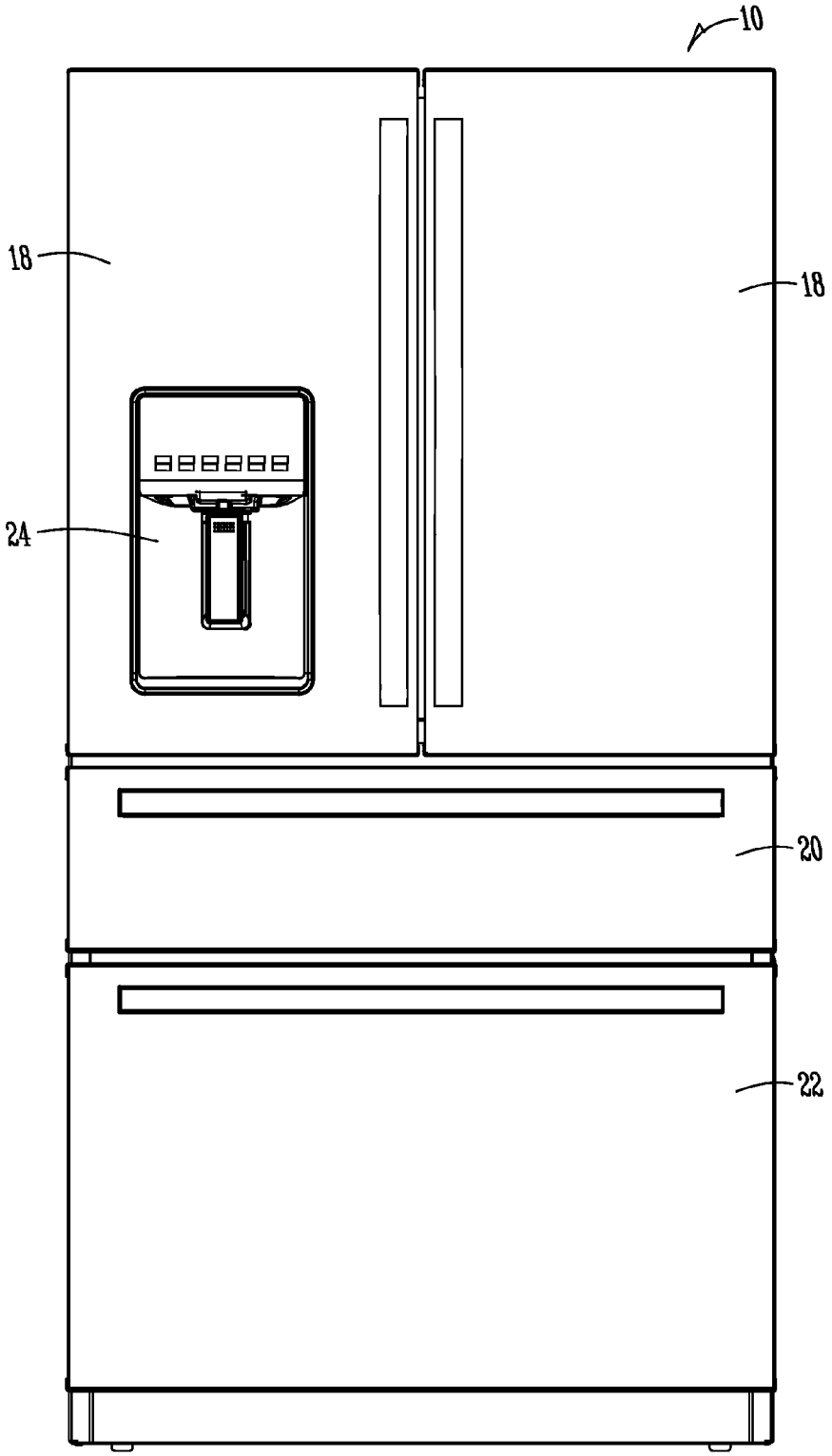
FIG. 1 is a pictorial representation of a refrigerator in accordance with an illustrative embodiment.
Figure 2:
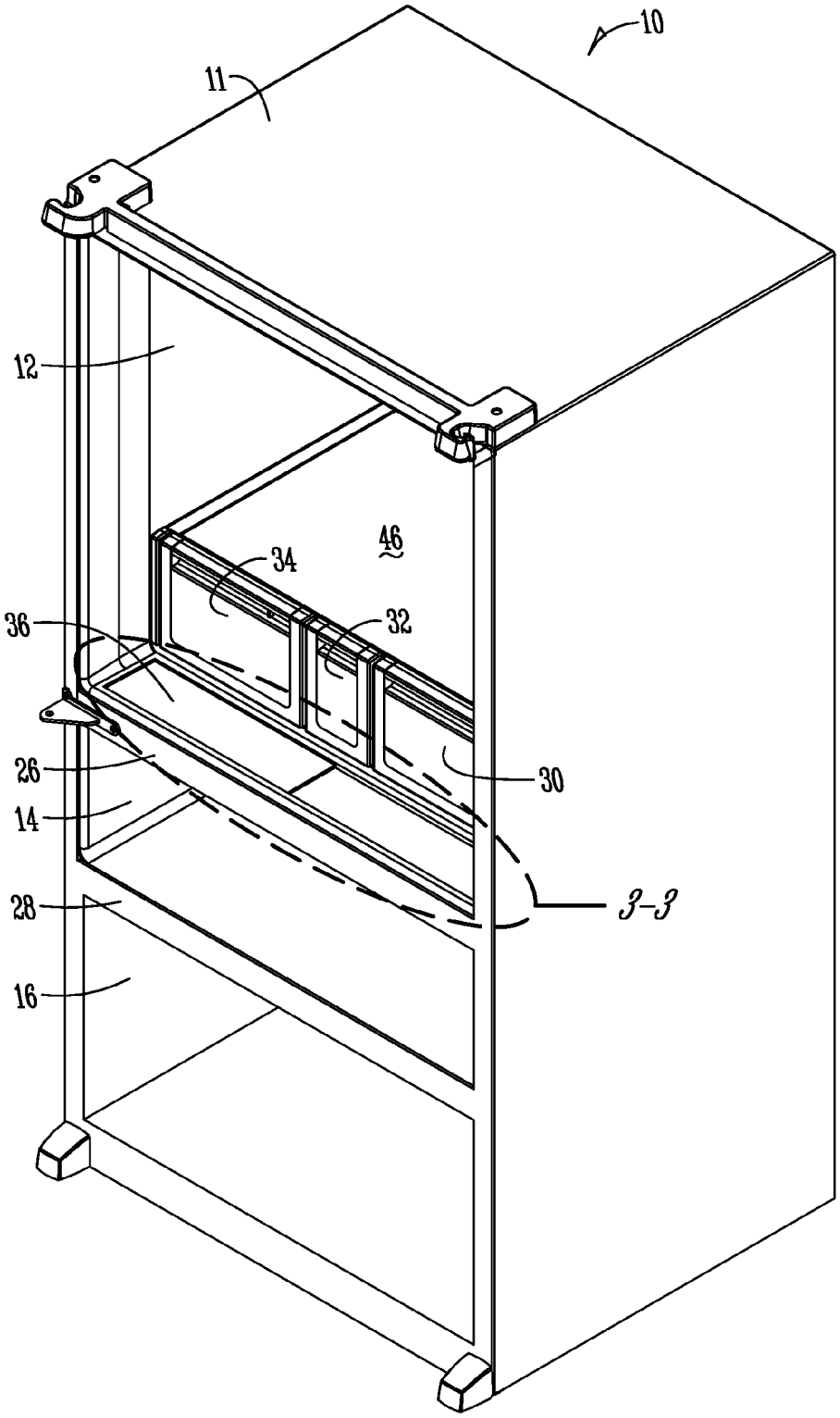
FIG. 2 is a pictorial representation of a refrigerator with doors removed for purposes of showing an illustrative embodiment.

Generally illustrated pictorially in FIGS. 1-2 is a bottom mount refrigerator 10. The refrigerator 10 includes a cabinet 11 housing one or more compartments, such as a refrigerated or fresh food compartment 12, refrigerated or fresh food compartment 14 (e.g., a pantry compartment), and freezer compartment 16. Doors are provided for selectively opening and closing the aforementioned compartments. Specifically, doors 18 are provided for the refrigerated or fresh food compartment 12, door 20 for the refrigerated or fresh food compartment 14 and door 22 for the freezer compartment 16. One of the doors 18 includes an ice dispenser 20, which may also include a water dispenser. Optionally, the refrigerator 10 may be configured without water and/or ice dispenser.

Figure 3:
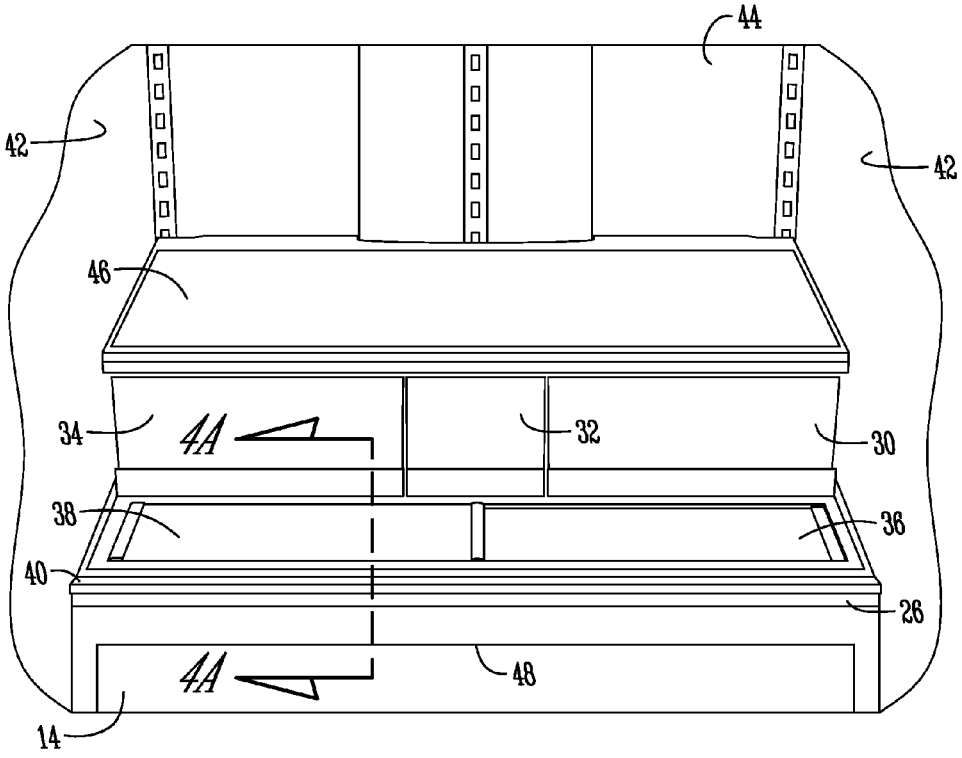
FIG. 3 is a pictorial representation a storage compartment taken along line 3-3 in FIG. 2 in accordance with an illustrative embodiment.

As best illustrated in FIG. 2, the refrigerated or fresh food compartment 12 may include a shelving or bin system, such as for example one or more bins 30, 32, 34 slideably supported underneath shelf 46. The bins 30, 32, 34 may be configured to extend across the refrigerated compartment 12. As illustrated in FIG. 3, the refrigerated compartment 12 includes side walls 42 spaced apart by a back wall 44 and a mullion 26 having a top wall 40 spaced between the side walls 42 and the back wall 44. The bins 30, 32, 34 may be configured to slide atop the top wall 40 of the mullion 26. The bins 30, 32, 34 may be configured to have a depth less than the depth of the side walls 42 so that the front of the bins 30, 32, 34 are set back away from the doors 18 when in the closed position as illustrated in FIG. 1.

Beneath the bins 30, 32, and 34 is a mullion 26 that includes a top wall 40 and a bottom wall 48. The mullion 26 separates the refrigerated compartment 12 from the refrigerated compartment 14. According to one aspect, the mullion 26 may be configured to separate the refrigerated compartment 12 from a refrigerated pantry compartment 14. The refrigerator 10 also includes a mullion 28 spaced between the refrigerated compartment 14 and freezer compartment 16. The mullions 26, 28 are configured to extend generally between side walls 42 and to back wall 44. The refrigerated compartment 14 may be configured as a freezer compartment, similar to freezer compartment 16. Accordingly, mullion 28 could be configured to separate a pair of freezer compartments or a pair of refrigerated or fresh food compartments. Similarly, mullion 26 may be configured to separate a pair of refrigerated or fresh food compartments.

Disposed within mullion 26 is a storage compartment 36 accessible through doors 18. The storage compartment 36 is set back from the front edge of the mullion 26 and has a length generally extending between side walls 42 and a depth extending rearward toward back wall 44 terminating generally at, in front of or underneath bins 30, 32, 34. In one aspect, the storage compartment 36 may be configured to extend partially underneath bins 30, 32, 34. In another aspect, storage compartment 36 may be configured to terminate generally at the vertical face of each bin 30, 32, 34. The front wall of the storage compartment 36 may be configured generally adjacent the front wall edge of mullion 26 or may be set back a distance from the front wall edge of mullion 26 in accordance with one or more embodiments of this disclosure.

Figure 4A:
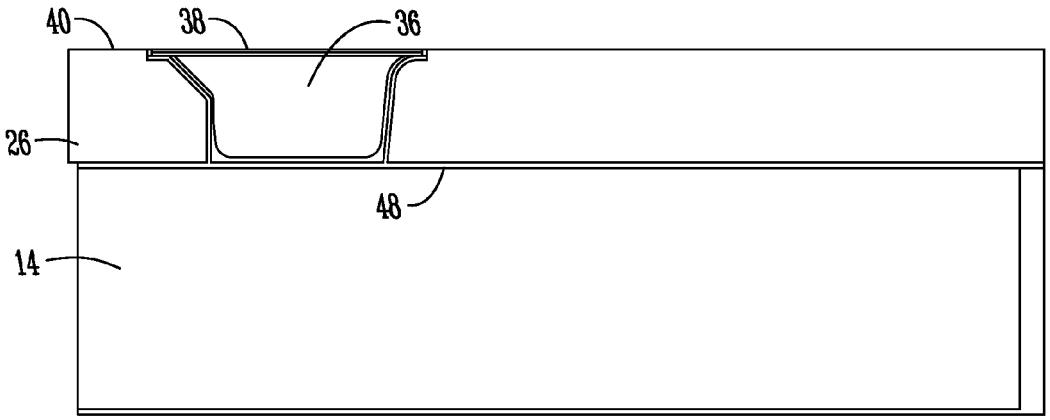
FIGS. 4A is a pictorial representation of sectional view taken along line 4A-4A in FIG. 3 in accordance with an illustrative embodiment.
Figure 4B:
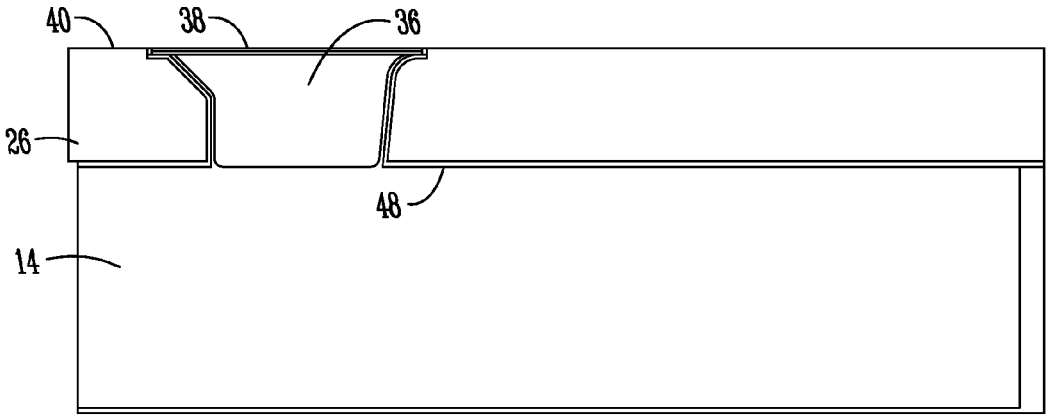
FIGS. 4B is pictorial representation of a storage compartment configuration in accordance with an illustrative embodiment.

FIGS. 4A-4B illustrate pictorially the depth of the storage compartment 36 and possible configurations within a refrigerator, such as in a mullion wall between two compartments. According to one aspect, the bottom wall 48 of the mullion 26 may be configured to support and/or form a part of the bottom wall of the storage compartment 36. FIG. 4A provides an illustrative embodiment of the storage compartment 36 with the front wall of the storage compartment 36 being set back from the front edge of the mullion 26. The storage compartment 36 may be configured having a length extending generally between the side walls 42 of the refrigerated compartment 12. The length of the storage compartment extends rearward toward the back wall 44 of the refrigerated compartment 12 and terminates generally at the forward vertical faces of bins 30, 32, 34. One or more covers 38, 39 (see FIGS. 5A-5B) are configured over the opening of the storage compartment 36. According to one aspect, the compartment walls 52, best illustrated in FIGS. 5A-5B, may be insulated or include one or more heating elements to control the temperature within the storage compartment 36. In the case where the refrigerated compartment 14 is configured as a freezer compartment, one or more of the compartment walls 52 may be configured to receive freezer air to provide a storage compartment 36 capable of operating at temperatures below the temperature of the refrigerated compartment 12. For example, as pictorially represented in FIG. 4B, the bottom wall of the storage compartment 36 may form a portion or part of the bottom wall 48 of the mullion 26. In such a configuration, temperature of the storage compartment 36 may be controlled in various manners, such as by the air temperature in the refrigerated compartment 14. In another aspect, the compartment 14 may be a freezer compartment and the storage compartment 36 may be chilled to temperatures below the temperature of the refrigerated compartment 12 by freezer compartment air. Conversely, the compartment 14 may be operated at a temperature above the temperature of the refrigerated compartment 12, such as by adjusting the air temperature in compartment 14 to be warmer than the air temperature in compartment 12.

Figure 5A:
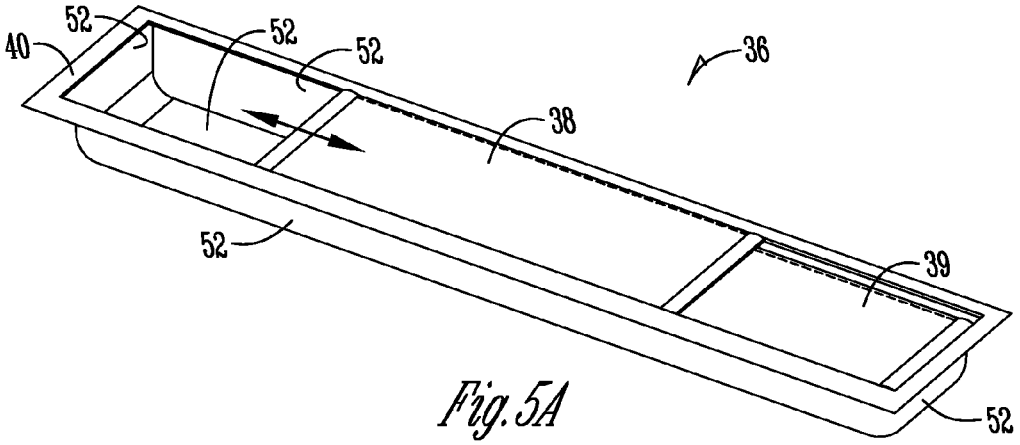
FIGS. 5A-5B are pictorial representations of a storage compartment and cover in accordance with an illustrative embodiment.
Figure 5B:
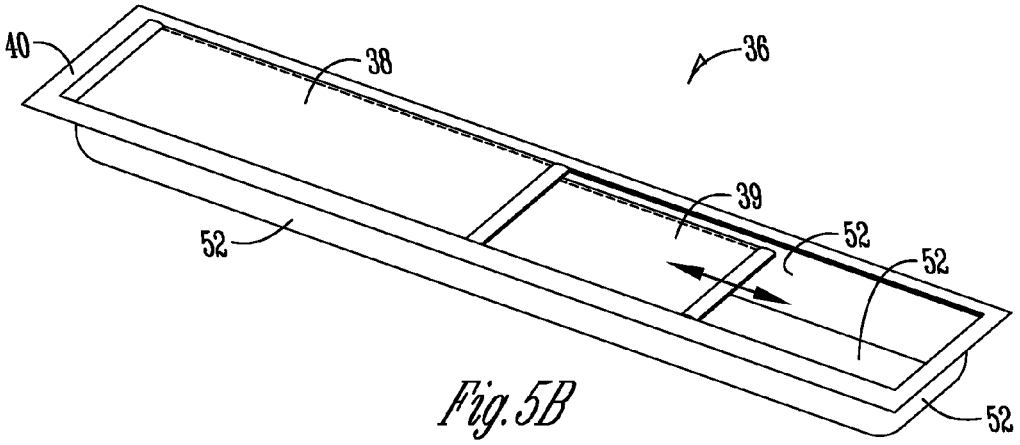

An illustrative embodiment of a storage compartment 36 is provided in FIGS. 5A-5B. The storage compartment 36 includes compartment walls 52 forming side walls spaced between end walls connected by a bottom wall. In one aspect, one or more or all walls 52 of the storage compartment 36 may be translucent, semitransparent, semiopaque, pellucid, limpid, or optically clear. As such, peering through the refrigerated compartment 12 one could see into the refrigerated compartment 14 shown in FIG. 4B by looking through the storage compartment 36. In another aspect, one or more or all walls 52 may be opaque. Similarly, portions of or the entire bottom wall 48 of mullion 26 may be translucent, semitransparent, semiopaque, pellucid, limpid, optically clear, or alternatively opaque. For example, peering through the refrigerated compartment 12 one could see into the refrigerated compartment 14 shown in FIG. 4A by looking through the storage compartment 36 and bottom wall 48. The storage compartment 36 may be configured with one or more dividers for segregating space within the storage compartment. Like the walls 52, the dividers or other components making up a part, portion or feature of the storage compartment 36 may be translucent, semitransparent, semiopaque, pellucid, limpid, optically clear, or alternatively opaque. The storage compartment 36 may be configured as one or more independent storage compartments with independent covers. As illustrated, a pair of covers 38, 39 are configured over the opening of the storage compartment 36. The covers may be translucent, semitransparent, semiopaque, pellucid, limpid, optically clear, or alternatively opaque. In one aspect, covers 38, 39 are configured as a pair of inter-sliding covers. FIG. 5A illustrates one cover 38 being moved from the closed position to an open position, FIG. 5B illustrates one cover 39 being moved from a closed position to an open position, and FIG. 3 illustrates covers 38, 39 in the closed position. In this manner, covers 38, 39 may be slid from one side to the other between side walls 42 of the refrigerated compartment 12 to provide access to the storage compartment 36. According to one aspect, a divider may be configured within compartment 36 generally proximate the terminal overlapping ends of covers 38, 39 so as to prevent items within the storage compartment 36 from being pushed into an opposite side of the storage compartment 36. Other configurations for covers 38, 39 are contemplated. For example, covers 38, 39 may be configured to slide rearward and forward to provide access to storage compartment 36. In this embodiment, covers 38, 39 may be configured to slide underneath bins 30, 32, 34 toward the back wall 44 when moved from a closed to an open position and back toward the front wall edge of the mullion 26 when moved from the open position to a closed position. Covers 38, 39 may be configured with one or more handles whereby the covers may be manipulated between opened and closed positions as best illustrated in FIGS. 5A-5B. Covers 38, 39 may be configured to rotate about a hinge point to allow the front edge of the covers (i.e. the edges nearest to the front wall edge of the mullion 26) to rotate up and down to provide access to the storage compartment 36. In another aspect, covers 38, 39 may be removable to allow access to the storage compartment 36 and replaceable to cover the storage compartment 36 when not in use. Covers 38, 39 may be removable to allow the covers to be cleaned and replaced, and to allow the storage compartment 36 to be cleaned. As previously indicated, one or more dividers may be included within the storage compartment 36 to divide up space within the storage compartment 36. The dividers may be adjustable across the length of the storage compartment 36 to adjust the space accordingly.

As illustrated in FIG. 4A, the bottom compartment wall 52 is generally adjacent the bottom wall 48 of mullion 26 which forms the top wall of refrigerated or fresh food compartment 14. In this manner, the temperature variance between the covers 38, 39 and the bottom compartment wall 52 of storage compartment 36 is generally equal or within a temperature range that does not cause uneven temperature distributions within the storage compartment 36. Thus, the covers 38, 39 generally see a temperature associated with refrigerated compartment 12 and the bottom compartment wall 52 of the storage compartment 36 generally sees the temperature associated with the refrigerated compartment 14. In this manner, an even temperature distribution is provided within the storage compartment 36. Temperature within the storage compartment 36 could also be user-specified or user-controlled. One or more heating elements could be configured to warm the storage compartment whereas freezer air could be moved into or about the storage compartment 36 for chilling it to a desired temperature, and in one aspect, even below the temperature of the refrigerated compartment 12 and/or refrigerated compartment 14. User controls could be provided for setting an operating temperature for the storage compartment 36.

Although embodiments of the disclosure include configuring mullion 26 with a storage compartment 36, other placements for a storage compartment, similar to storage compartment 36, are contemplated. For example, a similar storage compartment could be configured within mullion 28 separating refrigerated compartment 14 from freezer compartment 16. A similar type of storage compartment could be configured in the bottom wall of the freezer compartment 16. One or more of the side walls 42 or back wall 44 of the refrigerated compartment 12 could be configured with a similar storage compartment. Taking into consideration the temperature difference on the compartment walls making up the storage compartment may dictate where one or more of like storage compartments may be configured within the walls (e.g. mullion wall) of the cabinet 11 of refrigerator 10.

As illustrated in FIGS. 5A-5B, the storage compartment 36 may be configured as a modulated component of the refrigerator 10. For example, the storage compartment 36 may be removed whereby one may peer and even reach through the refrigerator compartment 12 into the refrigerator compartment 14 via access through the space that would otherwise be occupied by the storage compartment 36 as illustrated in FIG. 4B. In another aspect, with the storage compartment 36 removed one could peer through and/or reach the bottom wall 48 of the mullion via access through the space that would otherwise be occupied by the storage compartment 36 as illustrated in FIG. 4A. The storage compartment 36 could be configured as a modulated component whereby the storage compartment could be sized, shaped or otherwise designed according to use or variation in refrigerator models and styles. For example, the storage compartment could be one or more modulated compartments configured to be removably received within the space shown in FIGS. 4A-4B. In one aspect, two or more storage compartments could be configured to replace a single storage compartment. Alternatively, a blank or plug could be configured to occupy the storage compartment 36 space in a refrigerator model or style that does not offer such features. In the various embodiments, the modulated components could be removed for cleaning, replacement or swapping out with other modulated components. One compartment type could be configured for a desired operating temperature having one or more heating elements whereas another compartment type could be configured with additional insulation for operating at a desired temperature. Furthermore, one or more of the walls 52 could be configured with vents for introducing air into the compartment or passing air through the compartment. The compartment could be configured with one or more ducts for receiving warmer or cooler air than the temperature of the air in the refrigerated compartment 12 and/or refrigerator compartment 14. The depth of the storage compartment could be configured to exceed the depth of the mullion. As such, variations in the size, shape, features and modularity of the storage component are contemplated herein.

The present invention is not to be limited to the particular embodiments described herein. In particular, the present invention contemplates numerous variations in the type of ways in which embodiments of the invention may be applied to a storage compartment disposed in a mullion or like wall. The foregoing description has been presented for purposes of illustration and description. It is not intended to be an exhaustive list or limit any of the disclosure to the precise forms disclosed. It is contemplated that other alternatives or exemplary aspects that are considered included in the disclosure. The description is merely examples of embodiments, processes or methods of the invention. It is understood that any other modifications, substitutions, and/or additions may be made, which are within the intended spirit and scope of the disclosure. For the foregoing, it can be seen that the disclosure accomplishes at least all of the intended objectives.

The previous detailed description is of a small number of embodiments for implementing the invention and is not intended to be limiting in scope. The following claims set forth a number of the embodiments of the invention disclosed with greater particularity.

What is claimed is:

1. A refrigerator comprising:

a first upper compartment with opposite side walls selectively coverable by a first door and a second lower refrigerated fresh food compartment with opposite side walls selectively coverable by a second door;

a mullion between the first and second compartments and having a top, a bottom, and a front towards the first and second doors;

a storage compartment mountable in and located towards the front of the mullion and generally extending between the side walls of the first upper and second lower compartments, the storage compartment having a bottom wall with generally upstanding side walls;

wherein the storage compartment is separated from the first upper compartment by a selectively closeable lid;

wherein the bottom wall of the storage compartment comprises an internal top wall of the second lower refrigerated compartment.

2. The refrigerator of claim l wherein the storage compartment is located behind the front of the mullion.

3. The refrigerator of claim 1 wherein the first upper compartment comprises a refrigerated compartment and the second lower compartment comprises a refrigerated pantry compartment.

4. The refrigerator of claim 1 wherein the first upper compartment comprises a freezer compartment and the second lower compartment comprises a. refrigerated pantry compartment.

5. The refrigerator of claim l wherein the first upper compartment comprises a refrigerated pantry compartment.

6. The refrigerator of claim 1 wherein the selectively closeable lid comprises a pair of intersliding doors.

7. A refrigerator comprising:

two or more refrigerated compartments selectively coverable by one or more doors;

a mullion located between the two or more refrigerated compartments and having a top wall and a front towards the one or more doors;

a storage compartment mountable in and located towards the front of the mullion and formed in part by a set of compartment walls circumscribing an opening within the mullion, the set of compartment walls terminating at a bottom wall comprising at least one upper wall of a lower one of the two or more refrigerated compartments; and a selectively closeable lid disposed over the opening for separating the storage compartment from one of two or more refrigerated compartments.

8. The refrigerator of claim 7 wherein the selectively closeable lid comprises one or more sliding doors.

9. The refrigerator of claim 7 wherein the top wall comprises a generally upward facing wall, wherein the selectively closable lid is disposed over the opening in the generally upward facing wall.

10. The refrigerator of claim 9 wherein the upward facing wall forms a bottom wall of one of the two or more refrigerated compartments.

11. The refrigerator of claim 7 wherein the storage compartment comprises a bottom wall generally adjacent a bottom wall of the mullion.

12. The refrigerator of claim 7 wherein the mullion is located between a fresh food compartment and a pantry compartment.

13. The refrigerator of claim 7 wherein the refrigerator comprises a four door bottom mount refrigerator.

14. A refrigerator comprising:

a fresh food compartment selectively coverable by one or more doors;

a fresh food drawer disposed beneath the fresh food compartment;

a mullion disposed between the fresh food compartment and the fresh food drawer, the mullion having a top wall and a front towards the one or more doors;

a food storage compartment mountable in and located towards the front of the mullion, the food storage compartment having a bottom wall and side walls terminating in an opening disposed generally in the top wall of the mullion, wherein the bottom wall of the food storage compartment comprises an upper wall over the fresh food drawer; and a cover selectable between open and closed positions disposed over the opening of the food storage compartment.

15. The refrigerator of claim 14 wherein the mullion further comprises a bottom wall, wherein the bottom wall forms a top surface of a pantry compartment configured to receive the fresh food drawer.

16. The refrigerator of claim 15 wherein the food storage compartment is disposed generally between the top and bottom wall of the mullion.

17. The refrigerator of claim 14 wherein the food storage compartment is formed in part by a set of compartment walls circumscribing the opening disposed within the top wall of the mullion.

18. The refrigerator of claim 17 wherein the set of compartment walls are disposed beneath the top wall of the mullion.

19. The refrigerator of claim 14 wherein a portion of the top wall of the mullion is formed by the cover.

20. The refrigerator of claim 14 wherein the cover comprises a pair of intersliding doors.

* * * * *